US009140266B2

(12) United States Patent
Horng et al.

(10) Patent No.: US 9,140,266 B2
(45) Date of Patent: Sep. 22, 2015

(54) COOLING FAN

(75) Inventors: Alex Horng, Kaohsiung (TW); Wen-Kuan Chen, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 1080 days.

(21) Appl. No.: 13/204,755

(22) Filed: Aug. 8, 2011

(65) Prior Publication Data

US 2012/0269617 A1 Oct. 25, 2012

(30) Foreign Application Priority Data

Apr. 25, 2011 (TW) ..... 100114352 A

(51) Int. Cl.

| | |
|---|---|
| ***F04D 17/16*** | (2006.01) |
| ***F04D 25/06*** | (2006.01) |
| ***F04D 29/051*** | (2006.01) |
| ***F04D 27/00*** | (2006.01) |

(52) U.S. Cl.

CPC ..... *F04D 25/062* (2013.01); *F04D 17/16* (2013.01); *F04D 27/008* (2013.01); *F04D 29/051* (2013.01)

(58) Field of Classification Search

CPC ..... F04D 17/16; F04D 25/062; F04D 27/008; F04D 29/051

USPC ..... 415/203, 53.1, 129, 131, 132; 416/131, 416/133, 140

See application file for complete search history.

(56) References Cited

U.S. PATENT DOCUMENTS

| | | | | |
|---|---|---|---|---|
| 5,816,319 | A * | 10/1998 | Kamekawa et al. | 165/121 |
| 5,982,064 | A * | 11/1999 | Umeda et al. | 310/90 |
| 5,997,254 | A | 12/1999 | Tosaki | |
| 6,507,135 | B1 * | 1/2003 | Winkler | 310/91 |
| 6,964,556 | B2 * | 11/2005 | Chiu et al. | 415/205 |
| 7,390,166 | B2 * | 6/2008 | Chou | 415/220 |
| 7,416,388 | B2 | 8/2008 | Huang et al. | |
| 2005/0035670 | A1 * | 2/2005 | Chen et al. | 310/10 |
| 2005/0265834 | A1 * | 12/2005 | Wang et al. | 415/220 |
| 2009/0168351 | A1 | 7/2009 | Chen et al. | |
| 2010/0074746 | A1 * | 3/2010 | Huang | 415/220 |
| 2010/0329886 | A1 * | 12/2010 | Sung et al. | 416/244 R |

FOREIGN PATENT DOCUMENTS

| | | |
|---|---|---|
| TW | 553323 U | 9/2003 |

* cited by examiner

*Primary Examiner* — Nathaniel Wiehe
*Assistant Examiner* — Woody A Lee, Jr.
(74) *Attorney, Agent, or Firm* — Alan D. Kamrath; Kamrath IP Lawfirm, P.A.

(57) ABSTRACT

A cooling fan includes a base, a lid, a fan wheel, and an auxiliary shaft assembly. The lid is arranged above the base. The fan wheel has a shaft rotatably coupling with the base and a highest point spaced from the lid by a first gap. The auxiliary shaft assembly is arranged between a top of a hub of the fan wheel and a bottom face of the lid, with a second gap formed between the auxiliary shaft assembly and the top of the hub or between the auxiliary shaft assembly and the bottom face of the lid. The second gap is smaller than the first gap. Alternatively, the auxiliary shaft assembly has a first auxiliary shaft protruding from the top of the hub and a second auxiliary shaft disposed on the bottom face of the lid, with a second gap formed between the first and second auxiliary shafts smaller than the first gap.

12 Claims, 9 Drawing Sheets

COOLING FAN

BACKGROUND OF THE INVENTION

1. Field of the Invention

The present invention generally relates to a cooling fan and, more particularly, to a cooling fan able to prevent the top of a hub or a blade of a fan wheel from touching the bottom of a lid, such as a fan having an auxiliary shaft between the hub and the lid.

2. Description of the Related Art

Referring to FIG. 1, a conventional cooling fan 9 received inside a casing 90 to dissipate heat generated by a heat element 91 is shown. The cooling fan 9 has a base 92 where a shaft tube 93 is formed, with an outer periphery of the shaft tube 93 coupled with a stator 94, and with a bearing 95 received inside the shaft tube 93 and rotatably engaged with a shaft 961 of a fan wheel 96. The fan wheel 96 further includes a hub 962 and a plurality of blades 963 radially formed on the outer periphery of the hub 962. Top edges of the blades 963 are lower than or aligned with the top of the hub 962, and the fan wheel 96 also has a permanent magnet 964 to be driven by the stator 94. There is a gap "P" between the top of the hub 962 of the fan wheel 96 and a lid 97, so that the top of the hub 962 and the top edges of the blades 963 may not touch the lid 97 when the fan wheel 96 is rotated. Furthermore, a part of the shaft 961 of the fan wheel 96 can protrude from the bottom of the bearing 95, and a positioning ring can engage with the part of the shaft 961 protruding from the bottom of the bearing 95, to stabilize the axial position of the fan wheel 96 relative to the lid 97 when the fan wheel 96 is driven.

However, when there is only the gap "P" to prevent the top of the hub 962 and the top edges of the blades 963 from touching the lid 97, the fan wheel 96 easily goes upwards across the gap "P" and touches the lid 97, since the magnetic attraction between the permanent magnet 964 and the stator 94 is limited. Besides, although the positioning ring and the protruded part of the shaft 961 can further ensure the separation between the fan wheel 96 and the lid 97, the cooling fan 9 with these additional elements may lead to a complex structure that causes an increased manufacture cost. In light of this, it is desired to improve the conventional cooling fan.

SUMMARY OF THE INVENTION

It is therefore the primary objective of this invention to provide a cooling fan, with a hub and blades of a fan wheel prevented from touching a lid, to lower the operation noise and avoid damage of the cooling fan.

It is therefore another objective of this invention to provide a cooling fan constructed by a simple structure, to lower the manufacture cost of the cooling fan.

It is therefore another objective of this invention to provide a cooling fan having an auxiliary shaft assembly sandwiched between a fan wheel and a lid when the fan wheel lifts during operation, to enhance the rotation stability of the fan wheel.

The invention discloses a cooling fan comprising a base, a lid, a fan wheel, and an auxiliary shaft assembly. The lid is arranged above the base. The fan wheel has a shaft rotatably coupling with the base and a highest point spaced from the lid by a first gap. The auxiliary shaft assembly is arranged between a top of a hub of the fan wheel and a bottom face of the lid, with a second gap formed between the auxiliary shaft assembly and the top of the hub or between the auxiliary shaft assembly and the bottom face of the lid. The second gap is smaller than the first gap.

Furthermore, the invention discloses a cooling fan comprising a base, a lid, a fan wheel, and an auxiliary shaft assembly. The lid is arranged above the base. The fan wheel has a shaft rotatably coupling with the base and a highest point spaced from the lid by a first gap. The auxiliary shaft assembly is arranged between a top of a hub of the fan wheel and a bottom face of the lid, with the auxiliary shaft assembly having a first auxiliary shaft protruding from the top of the hub and a second auxiliary shaft disposed on the bottom face of lid, with a second gap formed between the first and second auxiliary shafts. The second gap is smaller than the first gap.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
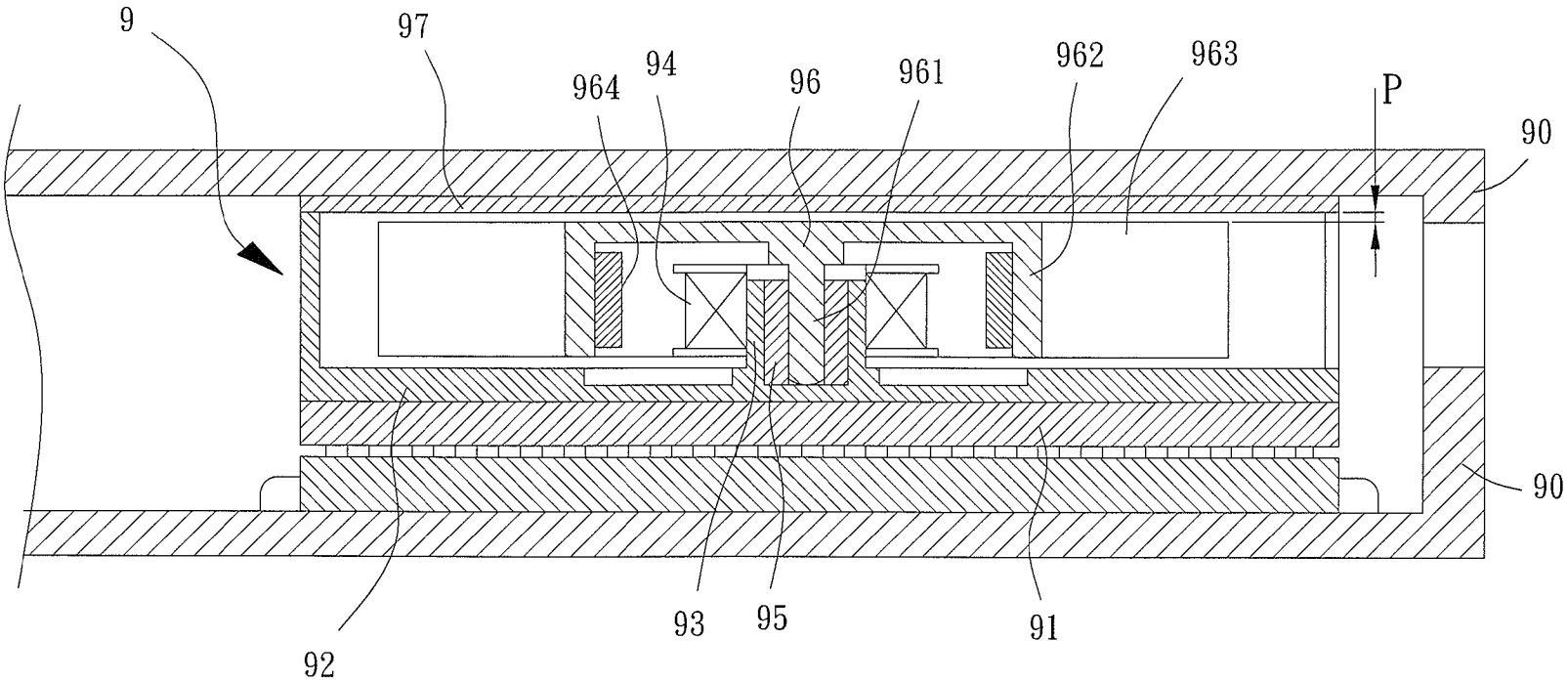
FIG. 1 PRIOR ART
FIG. 1 shows a cross-sectional view of a conventional cooling fan.

In the various figures of the drawings, the same numerals designate the same or similar parts. Furthermore, when the terms "first", "second", "third", "fourth", "inner", "outer", "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 2:
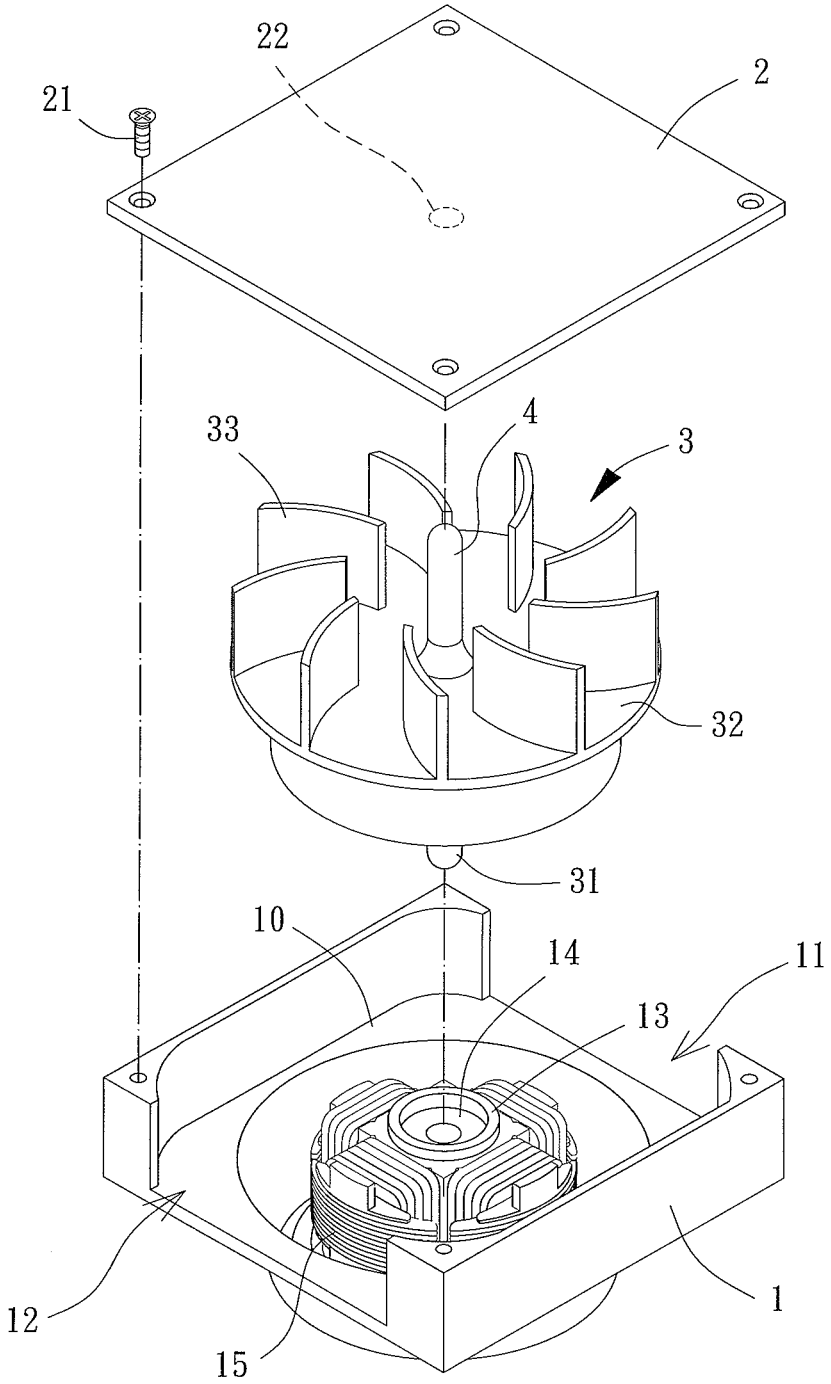
FIG. 2 shows an exploded, perspective view of a cooling fan according to a first embodiment of the invention.
Figure 3:
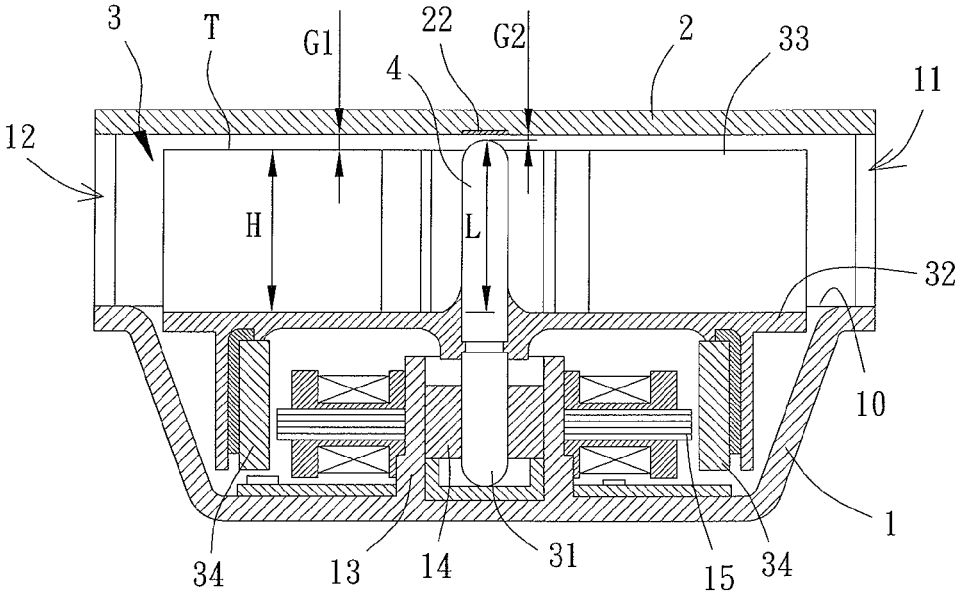
FIG. 3 shows a cross-sectional view of the cooling system of the first embodiment of the invention.

Referring to FIGS. 2 and 3, a cooling fan with a base 1, a lid 2, a fan wheel 3 and an auxiliary shaft assembly 4 is shown according to a first embodiment of the invention. The base 1 is adapted to support the fan wheel 3. The lid 2 is arranged on a side of the fan wheel 3 opposite to the base 1 to protect the fan wheel 3. The fan wheel 3 is able to rotate relatively to the base 1 and the lid 2. The auxiliary shaft assembly 4 is disposed between the lid 2 and the fan wheel 3 to prevent the fan wheel 3 from touching the lid 2.

The base 1 has an air channel 10 forming at least one first opening 11 and at least one second opening 12. Specifically, if the present cooling fan is an axial fan, the at least one first opening 11 and at least one second opening 12 are formed on two axial sides of the base 1, with the two axial sides spaced in an axial direction of the fan wheel 3. If the present cooling fan is a centrifugal fan, the at least one first opening 11 and at least one second opening 12 are formed on at least one of lateral sides of the base 1, with the lateral sides surrounding the fan wheel 3 in a circumferential direction of the fan wheel 3. If the present cooling fan is a mixed fan, the at least one first opening 11 is formed on one of the two axial sides of the base 1, and the at least one second opening 12 is form on at least one of the lateral sides of the base 1. Moreover, the base 1 can further provide a shaft tube 13 coupling with a connecting member 14, such as a bearing, and a stator 15.

The lid 2 is arranged above the base 1 and, specifically, is mounted on the top of the base 1 through a positioning member 21, with the positioning member 21 being a screw. However, the way to position the lid 2 on the base 1 can also be another conventional way, such as an elastic engagement or adhesion. Moreover, the bottom of the lid 2 can form a wear-resisting member 22 facing the auxiliary shaft assembly 4 for a free end of the auxiliary shaft assembly 4 to abut against, to enhance the rotation stability of the fan wheel 3.

The fan wheel 3 has a shaft 31 rotatably received in the shaft tube 13 of the base 1, while the connecting member 14 may connect between the shaft 31 and the shaft tube 13 for improving rotation smoothness of the shaft 31. The fan wheel 3 further includes a hub 32 where a plurality of blades 33 are mounted, and the blades 33 can extend by a protruding height "H" in an axial direction of the fan wheel 3 from the top of the hub 32. A permanent magnet 34 is disposed on an inner periphery of the hub 32 and faces the stator 15 of the base 1, so that the stator 15 can drive the fan wheel 3 to rotate and drive the air in the air channel 10 of the base 1. Therefore, an air flow can be induced in a direction from the at least one first opening 11 to the at least one second opening 12, or from the at least one second opening 12 to the at least one first opening 11. A highest point "T" of the fan wheel 3 is defined, with a first gap "G1" formed between the highest point "T" and the lid 2. That is, the highest point "T" is spaced from the lid 2 by the first gap "G1." Specifically, when the blades 33 axially extend by the protruding height "H," the highest point "T" is at a top edge of each the blade 33. However, the highest point "T" is at the top of the hub 32 if the blades 33 are laterally and radially formed on the hub 32 only and do not axially extend over the top of the hub 32. Moreover, the cooling fan shown in FIGS. 2 and 3 is completed by an outer rotor motor, with the stator 15 mounted on the shaft tube 13 and the permanent magnet 34 facing the stator 15 inwards. However, the cooling fan of the invention can also be completed by a conventional inner rotor motor, with the permanent magnet 34 mounted on the shaft 31 and facing the stator 15 outwards.

The auxiliary shaft assembly 4 is arranged between the top of the hub 32 of the fan wheel 3 and the bottom face of the lid 2. The auxiliary shaft assembly 4 can be a single rod connected with the top of the hub 32 of the fan wheel 3 or the bottom face of the lid 2, or can also be two separate rods respectively connected with the top of the hub 32 of the fan wheel 3 and the bottom face of the lid 2. In this embodiment, the auxiliary shaft assembly 4 is a single rod connected with the top of the hub 32 of the fan wheel 3, with the single rod integrally formed by the shaft 31. Preferably, the single rod serving as the auxiliary shaft assembly 4 is disposed on a rotational axis of the fan wheel 3 and has a predetermined length "L" larger than the protruding height "H." Specifically, a second gap "G2" is defined between the bottom face of the lid 2 and a free end of the signal rod serving as the auxiliary shaft assembly 4, and the second gap "G2" is smaller than the first gap "G1." Besides, when the second gap "G2" is decreased to zero, the free end of the signal rod abuts against the bottom of the lid 2, particularly against the wear-resisting member 22 of the lid 2, so that the auxiliary shaft assembly 4 may enhance the rotation stability of the fan wheel 3. Furthermore, the free end of the signal rod serving as the auxiliary shaft assembly 4 is preferably in a round shape or a taper shape if it is designed to abut against the bottom of the lid 2, to lower the friction between the signal rod and the lid 2 or the wear-resisting member 22.

Figure 4:
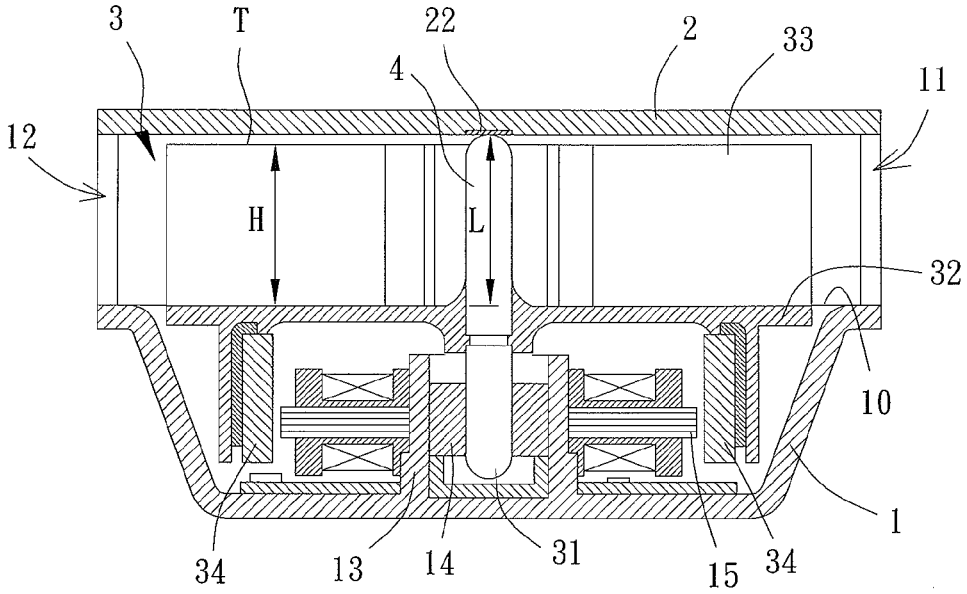
FIG. 4 shows a cross-sectional view of the cooling system of the first embodiment of the invention in operation.

Referring to FIG. 4, in operation of the presented cooling fan, when the fan wheel 3 is shifted towards the lid 2, only the auxiliary shaft assembly 4 is allowed to touch the bottom face of the lid 2, since the second gap "G2" is smaller than the first gap "G1" as well as the predetermined length "L" is larger than the protruding height "H." Therefore, the highest point "T" of the fan wheel 3, such as top edges of the blades 33 of the fan wheel 3 in this embodiment, is prevented from touching the bottom face of the lid 2. Specifically, the additional wear-resisting member 22 for the auxiliary shaft assembly 4 shifted along with the fan wheel 3 to abut against can thus enhance the rotation stability of the fan wheel 3.

Figure 5:
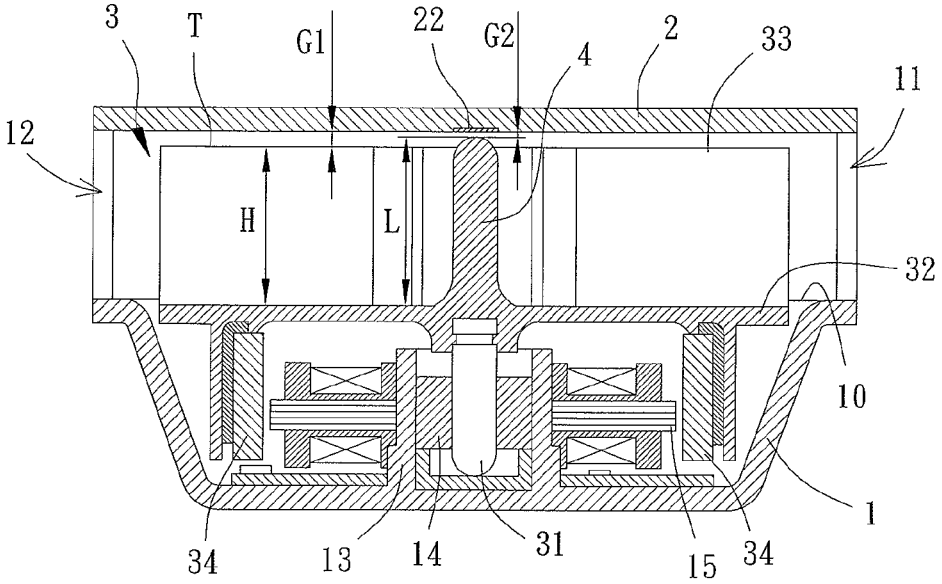
FIG. 5 shows a cross-sectional view of the cooling system of a second embodiment of the invention.

Referring to FIG. 5, a second embodiment of the cooling fan of the invention is shown. In this embodiment, the auxiliary shaft assembly 4 is in the form of a single rod integrally formed on the fan wheel 3, and is preferably made of the same material of the fan wheel 3 and formed on the top of the hub 32. Similarly, the second gap "G2" between the bottom face of the lid 2 and a free end of the signal rod serving as the auxiliary shaft assembly 4 is smaller than the first gap "G1" between the highest point "T" and the bottom face of the lid 2, or the predetermined length "L" is larger than the protruding height "H." Accordingly, the highest point "T" of the fan wheel 3, such as top edges of the blades 33 of the fan wheel 3 in this embodiment, is surely prevented from touching the bottom of the lid 2.

Figure 6:
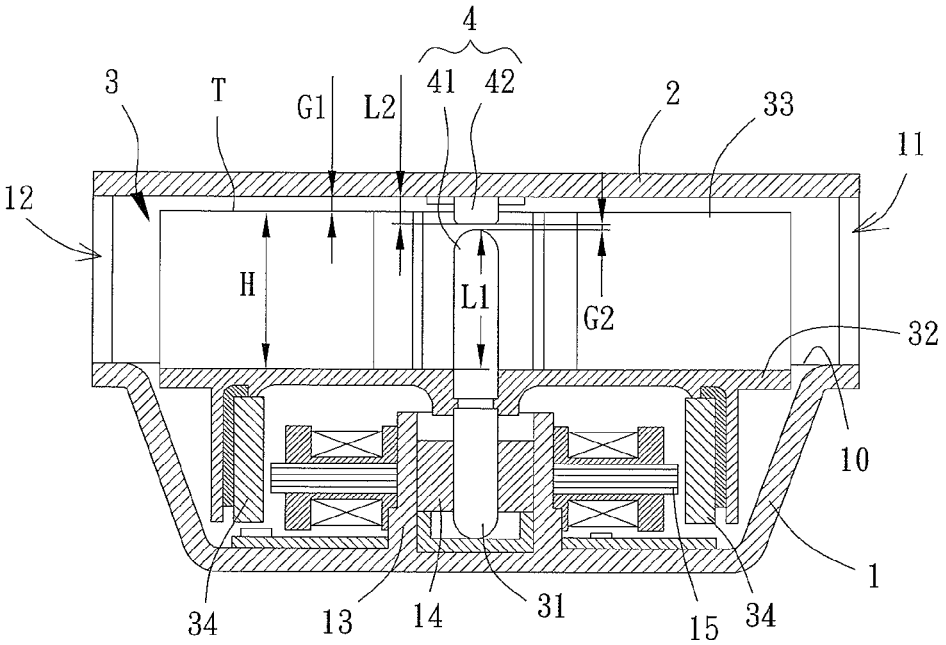
FIG. 6 shows a cross-sectional view of the cooling system of a third embodiment of the invention.

Referring to FIG. 6, a third embodiment of the cooling fan of the invention is shown. In comparison with the elements of the first embodiment, the major difference between the third and first embodiments lies in that the auxiliary shaft assembly 4 includes two separate parts in this embodiment, that is, a first auxiliary shaft 41 and a second auxiliary shaft 42. Specifically, the first auxiliary shaft 41 protrudes from the top of the hub 32, with the first auxiliary shaft 41 having a length "L1" and preferably integrally formed by the shaft 31. The second auxiliary shaft 42 with a length "L2" is disposed on the bottom face of lid 2 and extends towards the first auxiliary shaft 41, so that the lengths "L1," "L2" jointly define a predetermined length "L" of the auxiliary shaft assembly 4. Furthermore, in this embodiment, a gap between the first and second auxiliary shafts 41, 42 is defined as the second gap "G2", since the second auxiliary shaft 42 connects with the lid 2 and since there is no separation between the auxiliary shaft assembly 4 and the lid 2 in this embodiment. Similarly, the predetermined length "L" is larger than the protruding height "H," or the second gap "G2" between the first and second auxiliary shafts 41, 42 is smaller than the first gap "G1" between the highest point "T" and the bottom face of the lid 2. Both of the first and second auxiliary shafts 41, 42 are preferably disposed on the rotational axis of the fan wheel 3, with at least one of two free ends of the first and second auxiliary shafts 41, 42, which face each other oppositely, in a round shape or a taper shape to lower the friction between the first and second auxiliary shafts 41, 42 when in contact with each other. Therefore, it is impossible for the highest point "T" of the fan wheel 3, such as top edges of the blades 33 of the fan wheel 3 in this embodiment, to touch the bottom of the lid 2, since the touched first and second auxiliary shafts 41, 42 can prevent any further axial collision between the blades 33 and the lid 2.

Figure 7:
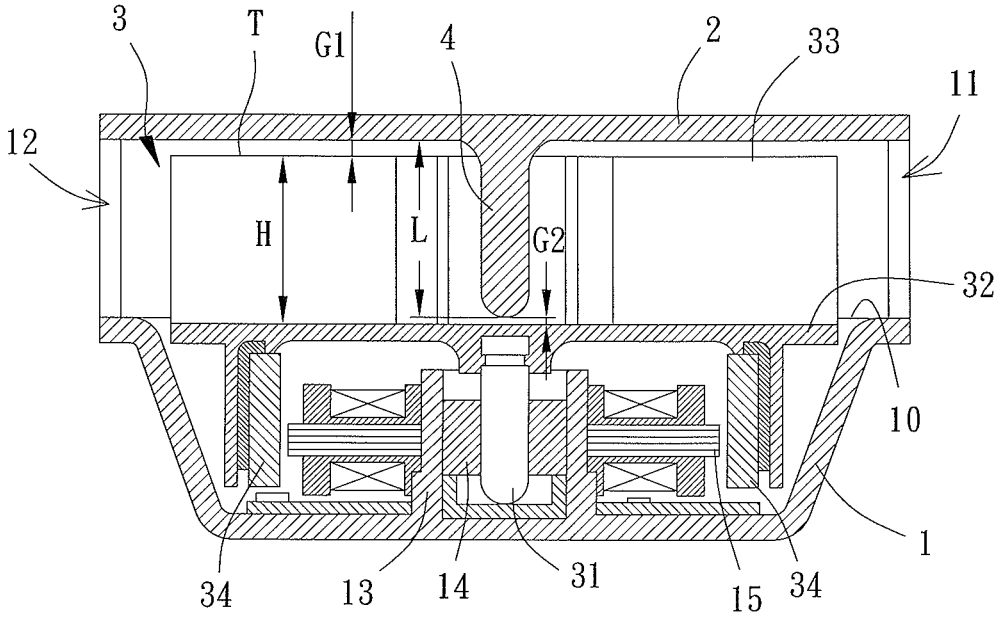
FIG. 7 shows a cross-sectional view of the cooling system of a fourth embodiment of the invention.

Referring to FIG. 7, a fourth embodiment of the cooling fan of the invention is shown. In this embodiment, the auxiliary shaft assembly 4 is in the form of a single rod integrally formed on the lid 2, and is preferably made of the same material of the lid 2 and formed on the bottom face of the lid 2. Besides, in this embodiment, a gap between the single rod serving as the auxiliary shaft assembly 4 and the hub 32 of the fan wheel 3 is defined as the second gap "G2", since the single rod connects with the lid 2 and since there is no separation between the auxiliary shaft assembly 4 and the lid 2 in this embodiment. Similarly, the second gap "G2" between the auxiliary shaft assembly 4 and the fan wheel 3 is smaller than the first gap "G1" between the highest point "T" and the bottom face of the lid 2, or the predetermined length "L" is larger than the protruding height "H." Therefore, it is impossible for the highest point "T" of the fan wheel 3, such as top edges of the blades 33 of the fan wheel 3 in this embodiment, to touch the bottom of the lid 2, since the auxiliary shaft assembly 4 and the fan wheel 3, which may abut against each other in operation, can prevent any further axial collision between the blades 33 and the lid 2.

Figure 8:
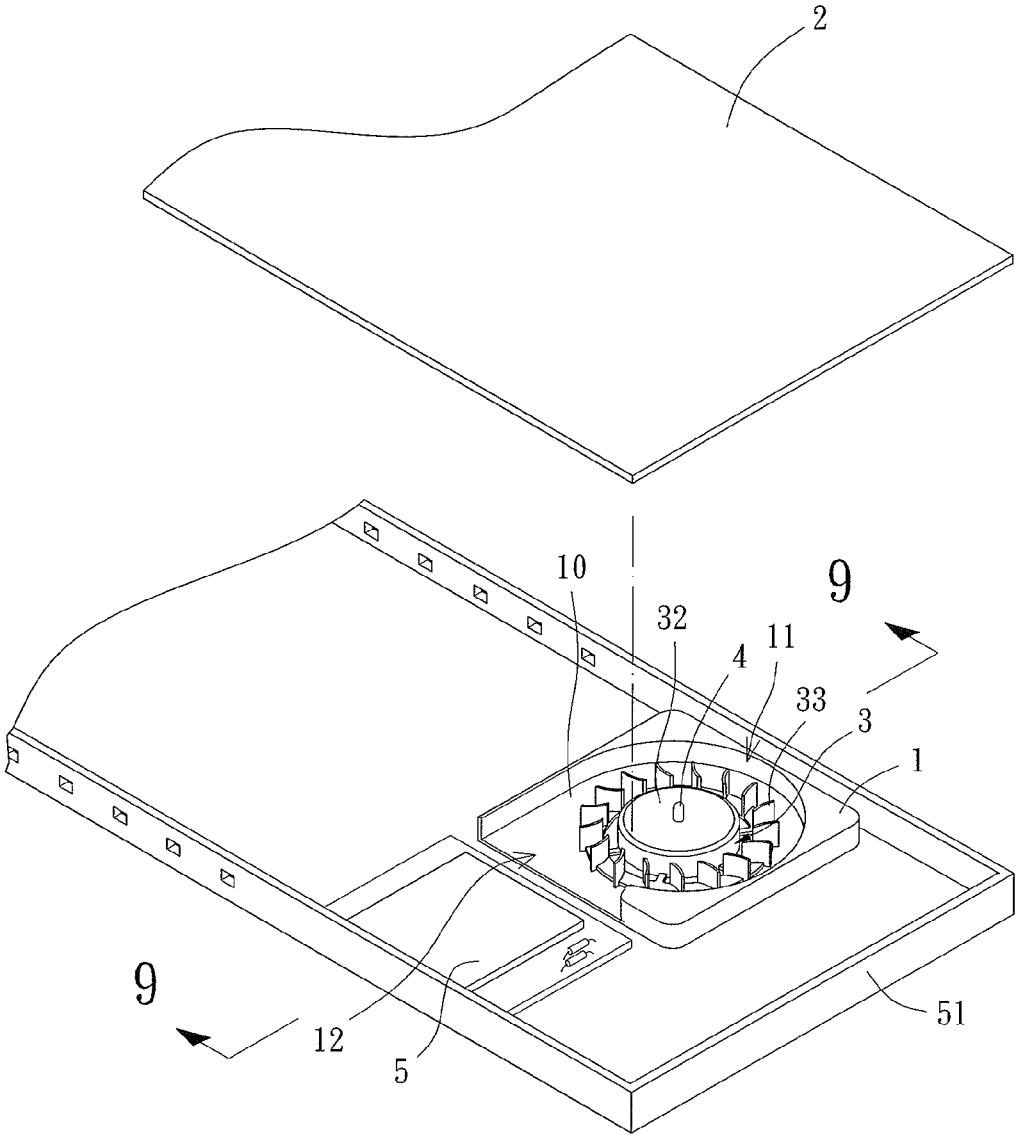
FIG. 8 shows an exploded, perspective view of the cooling system of a first example of a practical arrangement of the present invention.
Figure 9:
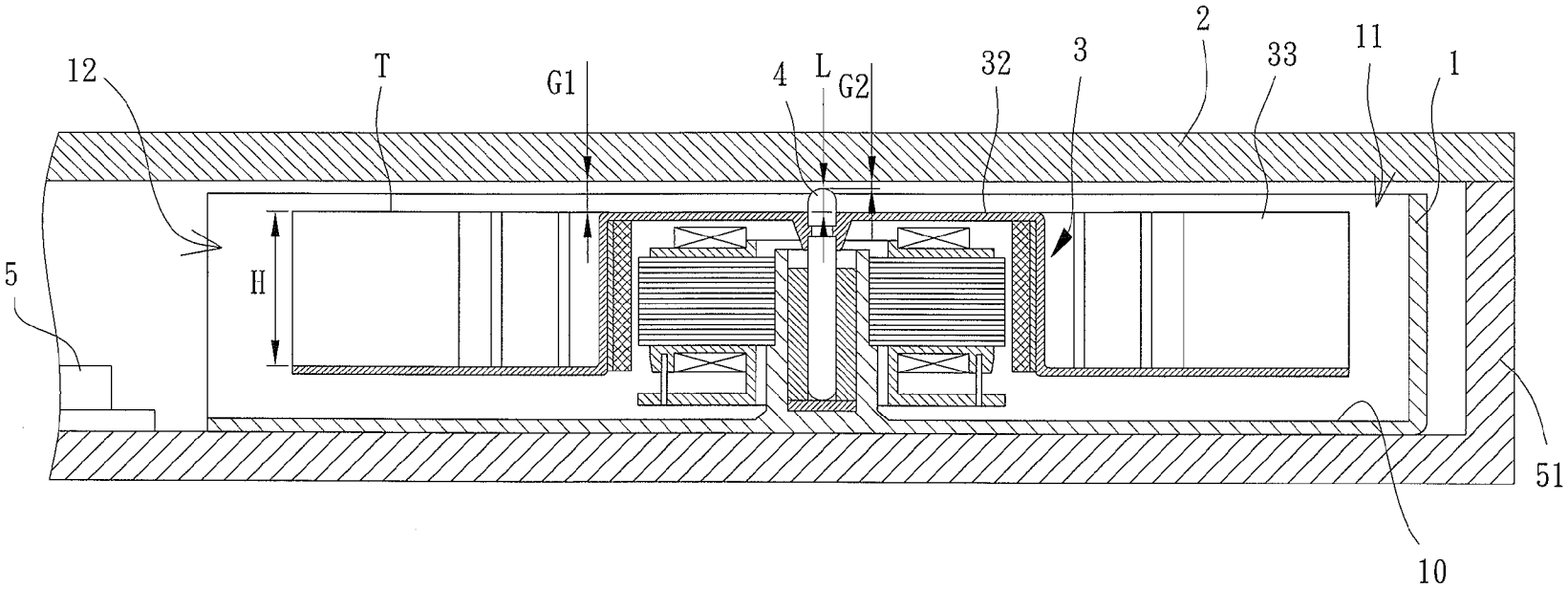
FIG. 9 shows a cross-sectional view of the cooling system of the first example of the practical arrangement of the present invention.
Figure 10:
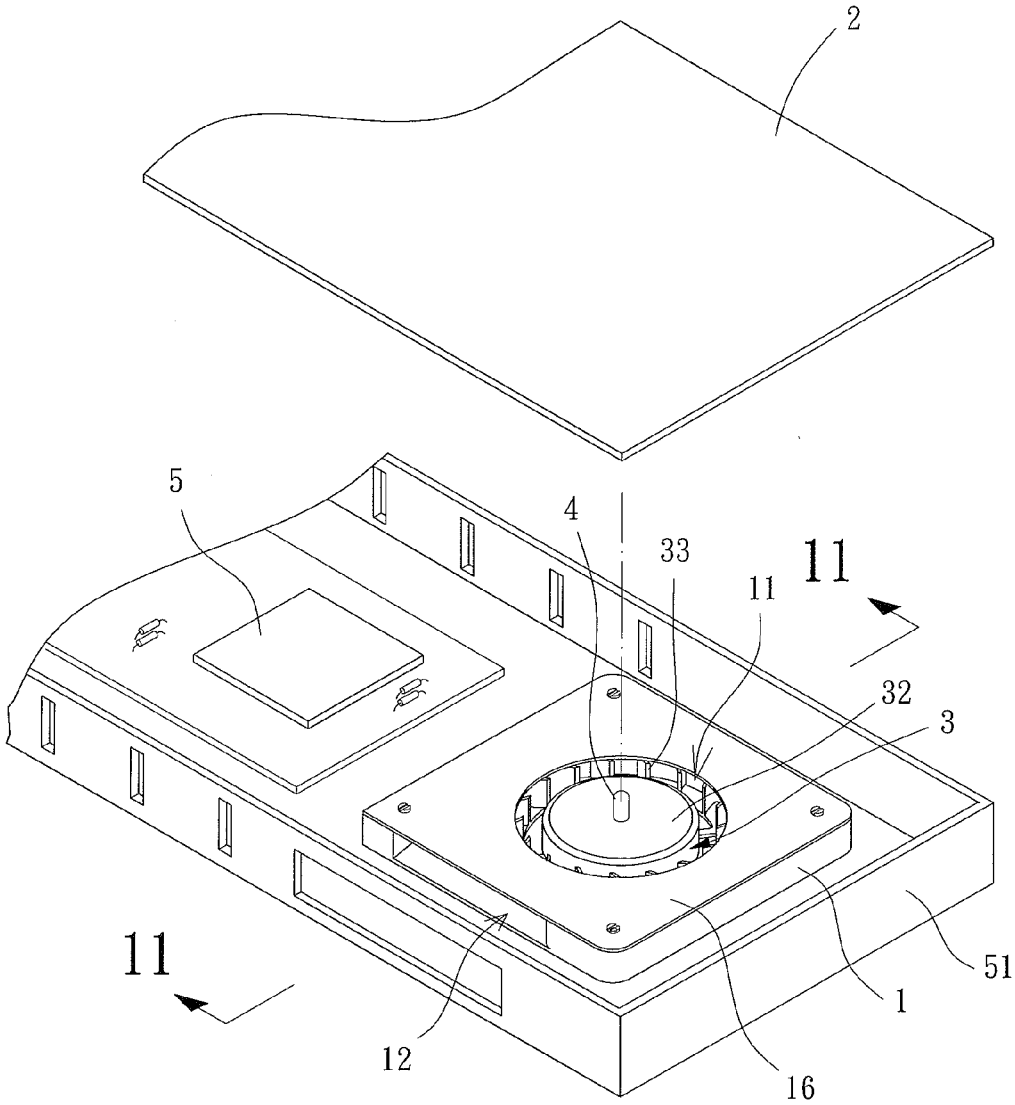
FIG. 10 shows an exploded, perspective view of the cooling system of a second example of a practical arrangement of the present invention.
Figure 11:
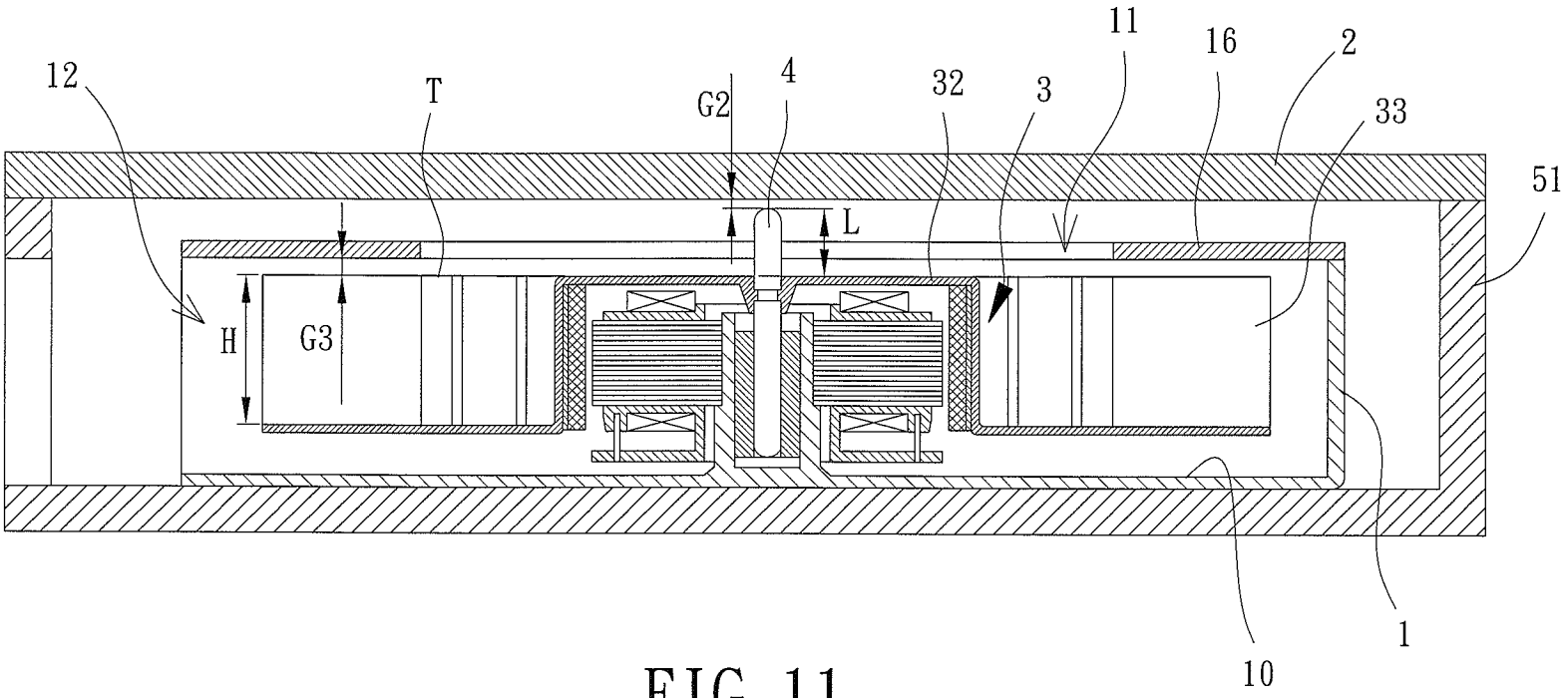
FIG. 11 shows a cross-sectional view of the cooling system of the second example of the practical arrangement of the present invention.

Please refer to FIGS. 8-10 which illustrate two examples of practical arrangements of the present invention. The fan wheel 3 is rotatably coupled with the base 1 for the blades 33 to drive the air to flow from the at least one first opening 11 to the at least one second opening 12 in the air channel 10. The base 1, the fan wheel 3, the auxiliary shaft assembly 4 and a heat element 5 that heats the surrounding air are received inside a housing 51, and the lid 2 is a cover plate of the housing 51. In the first example, as shown in FIGS. 8 and 9, the at least one second opening 12 of the base 1 is adjacent to the heat element 5 for the driven air flow outputted by the at least one second opening 12 to blow away the hot air around the heat element 5. In the second example, as shown in FIGS. 10 and 11, the cooling fan draws the hot air around the heat element 5 via the at least one first opening 11 of the base 1 and expels the hot air via the at least one second opening 12 of the base 1. Specifically, in the second example, a protective plate 16 is arranged on the base 1 by any conventional way for combination such as by elastic engagement or adhesion, with the protective plate 16 defining the first opening 11 and arranged above the blades 33 of the fan wheel 3.

Moreover, with reference to FIG. 11, since the protective plate 16 is added and the fan wheel 3 directly faces the protective plate 16, a gap between the highest point "T" and the bottom face of the protective plate 16 is defined as a third gap "G3," with the second gap "G2" between the auxiliary shaft assembly 4 and the lid 2 smaller than the third gap "G3" between the highest point "T" and the bottom face of the protective plate 16, or with the predetermined length "L" larger than the protruding height "H." Accordingly, the highest point "T" of the fan wheel 3, such as top edges of the blades 33 of the fan wheel 3, is surely prevented from touching the bottom of the protective plate 16.

In summary, the cooling fan of the present invention can surely prevent the fan wheel 3 from touching the lid 2 based on the arrangement of the auxiliary shaft assembly 4 between the fan wheel 3 and the lid 2, to lower the operation noise and avoid damage of the cooling fan. Besides, the arrangement of the above elements is simple and may not further complicate the structure of the cooling fan, to lower the manufacture cost thereof. Furthermore, the auxiliary shaft assembly 4 can enhance the rotation stability of the fan wheel 3 even through the fan wheel 3 lifts during operation.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A cooling fan comprising:

a base;

a lid arranged above the base;

a fan wheel having a shaft rotatably coupling with the base and a highest point spaced from the lid by a first gap; and an auxiliary shaft assembly arranged between a top of a hub of the fan wheel and a bottom face of the lid, with a second gap formed between the auxiliary shaft assembly and the top of the hub or between the auxiliary shaft assembly and the bottom face of the lid, wherein the second gap is smaller than the first gap, wherein the base has an air channel formed between the lid and the top of the hub, wherein the air channel includes at least one first opening and at least one second opening, and wherein the fan wheel further includes a plurality of blades received in the air channel, wherein the shaft extends from the hub, wherein the hub has a radial extent; wherein the plurality of blades extend radially with respect to the shaft to the radial extent of the hub and axially extend parallel to the shaft from the top of the hub to the highest point, with the plurality of blades located intermediate the hub and the bottom face of the lid, and with the plurality of blades located concentrically around the auxiliary shaft assembly and in the air channel within the radial extent of the hub between the top of the hub and the bottom face of the lid.

2. A cooling fan as claimed in claim 1, with the base forming a recess, wherein the hub of the fan wheel is received in the recess.

3. The cooling fan as claimed in claim 2, wherein the plurality of blades of the fan wheel extends by a protruding height in an axial direction of the fan wheel from the top of the hub, and wherein the auxiliary shaft assembly has a predetermined length larger than the protruding height.

4. The cooling fan as claimed in claim 2, wherein the auxiliary shaft assembly is a single rod connected with the top of the hub of the fan wheel.

5. The cooling fan as claimed in claim 4, wherein the auxiliary shaft assembly is integrally formed on the fan wheel.

6. The cooling fan as claimed in claim 4, wherein the auxiliary shaft assembly is integrally formed from the shaft.

7. The cooling fan as claimed in claim 4, wherein the bottom face of the lid forms a wear-resisting member facing the auxiliary shaft assembly.

8. The cooling fan as claimed in claim 2, wherein the auxiliary shaft assembly is disposed at a center of the fan wheel.

9. The cooling fan as claimed in claim 2, wherein a free end of the auxiliary shaft assembly is in a circular shape or a taper shape.

10. The cooling fan as claimed in claim 2, wherein the lid is mounted on the base.

11. The cooling fan as claimed in claim 2, wherein the air channel has at least one first opening and at least one second opening formed in the base, and wherein the base further has a shaft tube receiving the shaft of the fan wheel.

12. The cooling fan as claimed in claim 11, wherein the at least one first opening and the at least one second opening are formed on at least one lateral side of the base.

* * * * *